United States Patent [19]

Tipton

[11] 3,966,113

[45] June 29, 1976

[54] ONE PIECE BOX FOLDER

[75] Inventor: William G. Tipton, St. Louis, Mo.

[73] Assignee: Cavalier Packaging Company, Inc., St. Louis, Mo.

[22] Filed: May 14, 1975

[21] Appl. No.: 570,400

[52] U.S. Cl. ..... 229/40; 229/84

[51] Int. Cl.[2] ..... B65D 5/02

[58] Field of Search ..... 229/40, 82, 84, 87 R, 229/87 S, 1.5 R, 16 R, 87 A; 206/424

[56] References Cited

UNITED STATES PATENTS

| | | | |
|---|---|---|---|
| 276,962 | 5/1883 | Quillfeldt | 229/40 |
| 1,084,979 | 1/1914 | Todd | 229/84 |
| 1,741,059 | 12/1929 | Jones | 229/84 X |
| 2,762,553 | 9/1956 | Bentz | 229/40 |
| 3,295,741 | 1/1967 | Meyers | 229/40 |

FOREIGN PATENTS OR APPLICATIONS

| | | | |
|---|---|---|---|
| 1,367,693 | 6/1964 | France | 229/40 |

*Primary Examiner*—Stephen P. Garbe
*Attorney, Agent, or Firm*—Glenn K. Robbins

[57] ABSTRACT

A one piece box folder that requires no tucking of flaps and can be erected from a one piece blank. The box is assembled from a unitary blank in which the panels are folded over and connected to one another by physical affixation such as hot melt glue, pressure sensitive adhesive or other means of affixation. The front of the box is formed of at least two plies with a slot between a top ply and a bottom ply receiving an end tab of a cover. The slot through its thickness easily receives the end tab of the cover in self guiding relationship and tightly packed articles do not prevent the ready insertion of the tab. The top cover with the end tab forms with the top overlaying ply of the front a closely knit assemblage which resists inadvert opening by a relatively deep width of the hinged cover tending to keep the end tab within the slot closure.

3 Claims, 7 Drawing Figures

ONE PIECE BOX FOLDER

SUMMARY OF THE INVENTION

In the past various types of folding box have been provided in the packaging industry. Such boxes have been conventionally prepared from one piece blanks and set up in some cases by tucking the various panels together and in others by glueing the panels together or by other means of physical affixation such as stapling or the like. It has been a particular problem to provide a convenient easily set up box in which the contents can be tightly stored for ready withdrawal and at the same time provide a closure means which can be readily opened and closed for partial withdrawal of the contents while maintaining the box in a secure structural relationship.

By means of the instant invention there has been provided a simple one piece box folder prepared from a single blank in which the various panels can be connected together with a single securing means of a front panel member to underlying front panel sides or halves through a hot melt glue. It will be understood that other types of adhesive securing means or other securing means can be employed as desired.

The simply erected or manufactured box with underlying side panels forming the front of the box provides a slot in conjunction with the overlying bottom front half of the box to receive an end tab of a hinged top cover which is hinged from the top portion of the rear of the box. The end tab is received within the slot having a one ply thickness or width to readily receive the end tab even though the contents of the box may be tightly packed within the interior. The contents of the box can readily be withdrawn by simply removing the end tab and opening the front cover to expose the contents. A top portion of the underlying front side panels is cut in a half moon configuration for ready grasping of the contents. Typical of such contents can be elongated honing stones having a rectangular cross section which can be tightly packed within the box or any other type or contents as desired.

In one modification of the box a slot is formed by mating or registering cut-out portions in the side panels which when folded together to form the underlying front portion of the box provides a slot receiving the end tab under the folded over bottom portion of the front of the box. In another modification the slot is simply provided by a spacer panel extension of the overlying front portion which has an opening. This panel is bent underneath the front panel to overlay the underlying front side panels. This slot provided by the opening in the spacer is more in the nature of a pocket formed by the underlying thickness of the bent over panel which receives the end tab of the front cover. In both cases the slot provides a one ply thickness to readily receive the end tab or the cover even though the contents are tightly packed in the interior of the box. The front cover of the box is hinged from the top and has a depth extending from the top of the box to substantially half-way to the bottom to provide a snug tucking of the end tab in the slot and resist any tendency of the hinging means to accidently open the cover. Thus there is provided a box which is readily set up and has an extremely stable structure to maintain the contents in a tight packing, yet permitting the easy and ready opening of the box for withdrawal of the contents as desired.

The above features are objects of this invention and further objects will appear in the detailed description which follows and will otherwise be apparent to those skilled in the art.

For purpose of illustration of this invention there is shown in the accompanying drawings prefered embodiments thereof. It to be understood that these deawings are for the purpose of illustration only and that the invention is not limited thereto.

Figure 1:
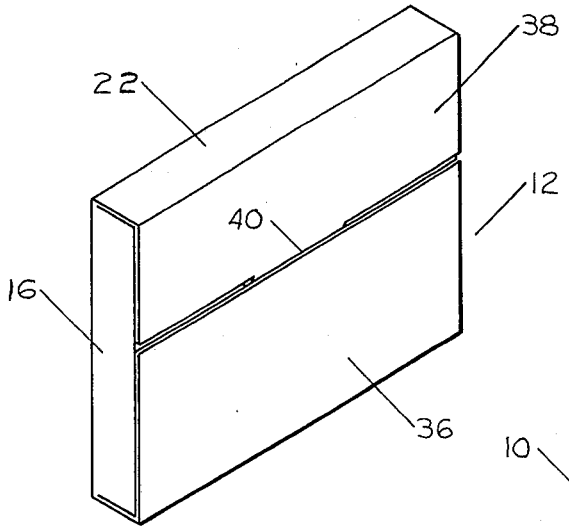
FIG. 1, is a pictorial view of the box of this invention shown in erected and box closed position.
Figure 2:
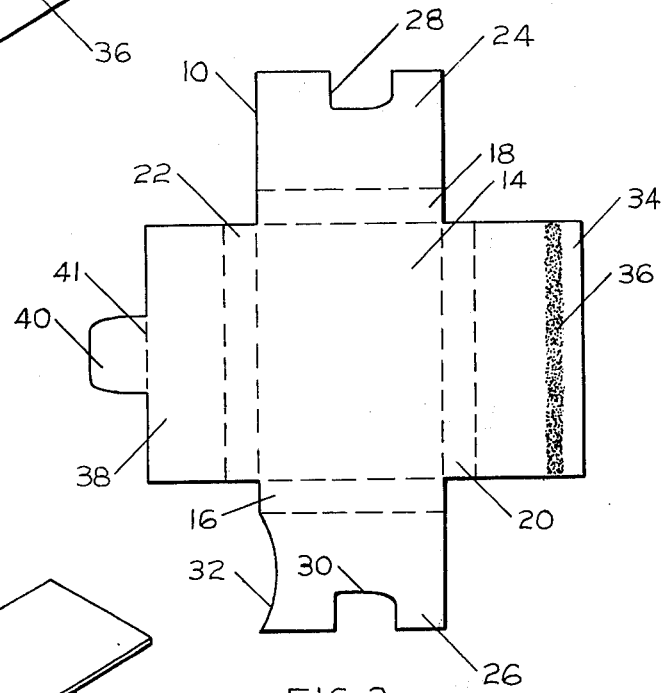
FIG. 2, is a plan view of a box blank.

DESCRIPTION OF THE INVENTION:

The one piece box folder of this invention is generally indicated by reference numeral 10 in the form of the blank shown in FIG. 2. The assembled box is shown by the reference numeral 12 in FIGS. 1, and 3.

The blank 10 is comprised of various panels separated by fold or score lines. Thus as shown in FIG. 2, a rear panel 14 is connected to narrow side panels 16 and 18 on both sides and to a bottom panel 20 and a top panel 22. Th side panels 16 and 18 are in turn connected to a right front side panel 24 and a left side front side panel 26, respectively. These panels have cutout openings 28 and 30 which form a tab receiving slot as will be further described. The left front side panel 26 is further provided with a shallow opening 32 which provides a means for ready grasping of the contents in the assembled box.

An overlying lower front panel 34 is connected to bottom panel 20. This panel is provided with a hot melt glue strip 36 for heat sealing the box together when it is assembled. It will be understood that other means of adhesive connections can be used such as pressure sensitive adhesive strips or any other physical affixation as desired.

A cover panel 38 which forms the upper front portion of the assembled box is connected to the top panel 22. The cover panel 38 is further provided with an end or tuck tab 40 which is adapted to be received within the tab receving slot in the assembled box.

Figure 3:
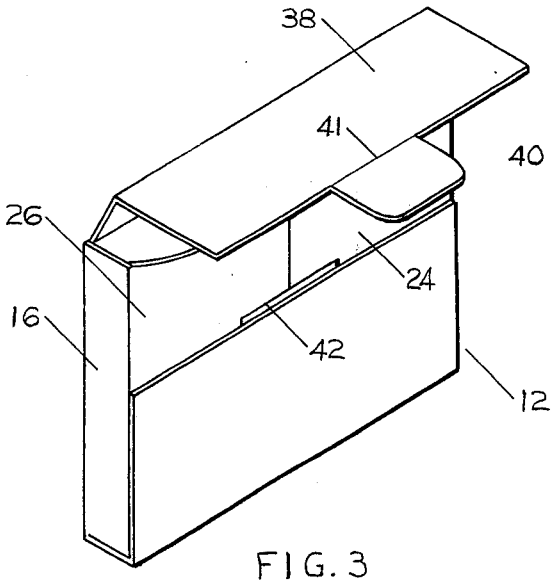
FIG. 3, is a view taken similarly to FIG. 1, but showing the box in partially opened position.

The box 12 is simply assembled from the blank 10 by bending over the front side panels 24 and 26 to meet one another in registry in the position shown in FIG. 3. The top front panel member 38 is then folded over to rest on top of the front side panels in overlying relationship. The lower front panels 34 is then bent over and is secured thereto by application of heat to melt the hot glue strip 36 to form a sealed connection. When the lower front panel member is thus connected as seen from FIG. 3, the panel overlies the major portion of the openings 28 and 30 and the side panels so that only a minor portion is exposed which forms the slot 42. This slot receives the end tab 40 of the front cover 38 as will be readily apparent from an ispection of FIGS. 1 and 3. The tuck tab 40 has a serve line 41 connecting it to the top panel to it to be easily bent into the slot. This scoreline also aids in maintaining the tab in the slot to keep the box closed. The tab is received within the thickness of the front side panels 24 and 26 so that when the contents of the box fill the interior there is still room for a snug engagement of the tab within the opening formed by the cut-out portions 28 and 30 in the front side panels. It will further be noted that the front cover forms a substantial portion of the distance between the top and the bottom of the front of the box which further aids in the secure closure of the box and minimizes accidental opening until this is positively effected by the user of the box.

Figure 4:
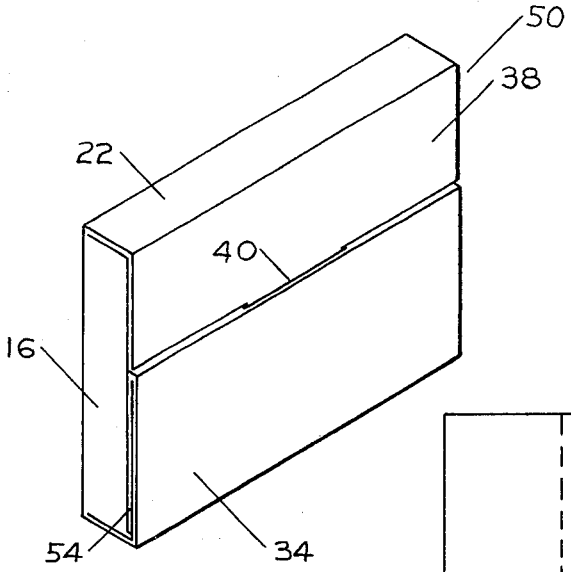
FIG. 4, is a pictorial view of a modification of the box of this invention.
Figure 5:
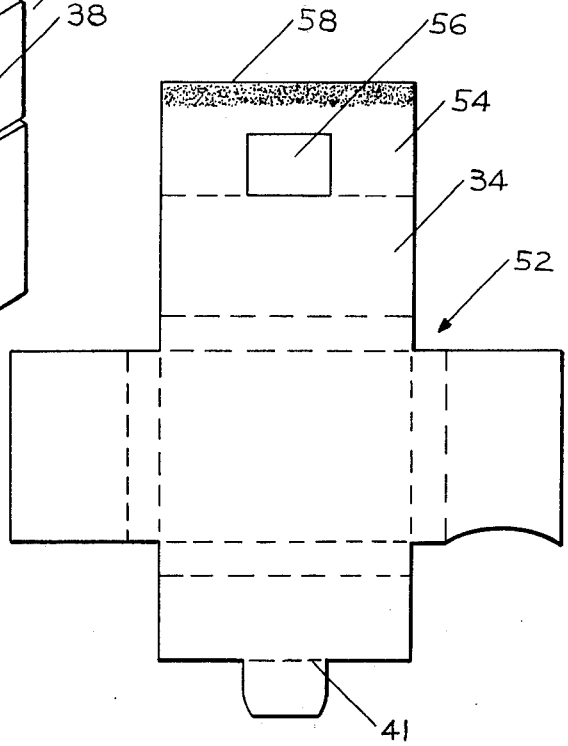
FIG. 5, is a top plan view of the box blank of FIG. 4.
Figure 6:
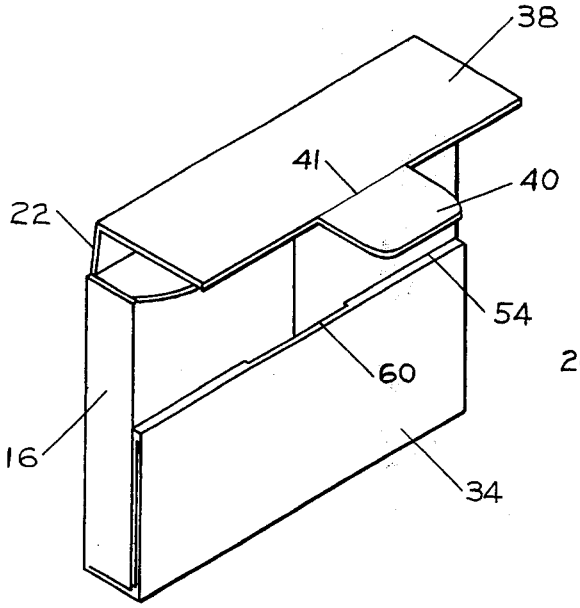
FIG. 6, is a pictorial view of the modified box in partially opened position.
Figure 7:
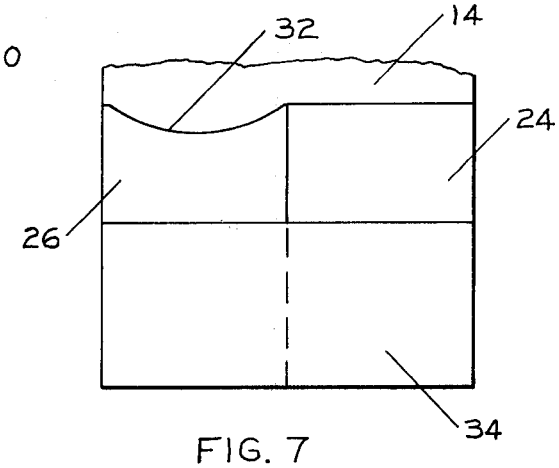
FIG. 7, is a fragmentary plan view showing the top portion of the front of the box of both FIGS. 3 and 6 at the ready grasping position for the contents.

A modified box of this invention is designated by reference numeral 50 in FIGS. 4, 5 and 6. A blank 52 is shown in FIG. 5, and identical reference numerals will be used for the same components in corresponding portions of the box as for the box of reference numeral 12. In the blank 52 the front side panels 26 and 28 are made in solid form without cut-out openings of the box 12. In addition the bottom front panel 34 has a panel extension 54 connected by a fold line. The panel extension 54 forms a spacer for the end tab and a slot for the reception of the end tab is formed by a cut-out opening 56 in this panel. The panel is further provided with hot melt glue strips 58 on both sides of the panels.

The box 50 is assembled from the blank 52 in much the same fashion as the box 12. Thus the front side panels are first bent over into engagement with one another as shown in FIG. 6. Then the extension panel member 54 is bent over against the lower front panel 34 and secured to it. The folded together front panels are then in turn folded over against the front side panels and secured thereto by heat application to the hot melt glue or other adhesive means may be employed as desired. In the assembled box the panels extension 54 forms a spacer or intermediate ply or layer between the front side panels 26 and 28 and the overlying lower front panel 34. When so connected the box provides a slot 60 formed by the opening 56 in the front spacer panel. This slot or pocket 60 readily recieves the end tab 40 of the front cover in much the same fashion as the tab receiving slot in the previously described box 12 in FIG. 1, through 3. In this modification of FIGS. 4 through 6 the tab is received within a slot or pocket having a thickness of the ply or layer of the spacer panel since the spacer panel has the same thickness as the end tab. The tab cover avoids contact with the contents of the box which factor may be desired in some applications.

Various changes and modifications may be made within this invention as will readily appear to those skilled in the art. Such changes and modifications are within the scope and teaching of this invention as defined by the claims appended hereto.

What is claimed is:

1. A one-piece box adapted to be erected from a foldable blank, said box having a front panel provided with a slot for receiving a tuck tab of a hinged cover panel, said front panel having a thickness substantially greater than the thickness of the tuck tab in order to receive said tuck tab within the front panel, said box comprising a rear panel foldably connected to top, bottom and a pair of side panels, said front panel being comprised of a pair of underlying front side panels foldably connected to said side panels and an overlying lower front panel foldably connected to said bottom panel and adhesive means securing said last named panels together, the hinged cover panel being foldably connected to said top panel and engageable in abutting relation against the upper portion of the underlying front panels, said front side panels being provided with openings which provide a combined opening receiving said tuck tab, said combined opening having a major portion underlying the overlying lower front panel and a minor portion extending partially across the box above said lower front panel to provide said tuck tab receiving slot.

2. A One-piece box adapted to be erected from a foldable blank, said box having a front panel provided with a slot for receiving a tuck tab of a hinged cover panel, said front panel having a thickness substantially greater than the thickness of the tuck tab in order to receive said tuck tab within the front panel, said box comprising a rear panel foldably connected to top, bottom and a pair of side panels, said front panel being comprised of a pair of underlying front side panels foldably connected to said side panels and an overlying lower front foldably connected to said bottom panel panel and adhesive means securing said last named panels together, the hinged cover panel being foldably connected to said top panel and engageable in abutting relation against the upper portion of the underlying front panels' the overlying front panel being provided with a foldable spacer panel, said spacer panel being provided with said slot, said slot being of a size to receive said tuck tab, said spacer panel being folded underneath said lower front panel between it and said underlying front side panels.

3. The box of claim 2 in which said slot extends into the panel from a fold line separating said panel from the lower front panel.

* * * * *